US005222626A

United States Patent [19]

Reinschmidt et al.

[11] Patent Number: 5,222,626

[45] Date of Patent: Jun. 29, 1993

[54] HOUSING FOR ACCOMMODATING AT LEAST ONE CASSETTE CONTAINING IN PARTICULAR PAPER MONEY

[75] Inventors: Jörg Reinschmidt, Ammerbuch; Walter Mannsdörfer, Aidlingen; Heinz Lutz, Breitenstein, all of Fed. Rep. of Germany

[73] Assignee: International Business Machines Corporation, Armonk, N.Y.

[21] Appl. No.: 805,286

[22] Filed: Dec. 10, 1991

[30] Foreign Application Priority Data

Dec. 10, 1990 [DE] Fed. Rep. of Germany ..... 4039396

[51] Int. Cl.[5] ..... B65H 1/00

[52] U.S. Cl. ..... 221/197; 312/183

[58] Field of Search ..... 221/197, 4, 7, 164, 221/154; 271/162, 163; 312/97.1, 183

[56] References Cited

U.S. PATENT DOCUMENTS

| | | | |
|---|---|---|---|
| 4,088,082 | 5/1978 | Pudras | 109/53 |
| 4,314,733 | 2/1982 | Smith | 312/183 |
| 4,655,368 | 4/1987 | Bateman et al. | 221/197 |
| 4,775,783 | 10/1988 | Sasaki et al. | 235/359 |

FOREIGN PATENT DOCUMENTS

| | | | |
|---|---|---|---|
| 2148973 | 3/1973 | France . | |
| 250195 | 10/1989 | Japan | 221/197 |

*Primary Examiner*—Robert P. Olszewski
*Assistant Examiner*—Kenneth Noland
*Attorney, Agent, or Firm*—Karl O. Hesse

[57] ABSTRACT

A secure housing in an automatic teller machine for accommodating cassettes attached to a carrier frame which by means of slide rail assemblies is fixed to the upper portion or wall of the housing is disclosed. This wall is provided with an output opening out of which bank notes or other documents may be issued reliably to a transport mechanism.

6 Claims, 3 Drawing Sheets

HOUSING FOR ACCOMMODATING AT LEAST ONE CASSETTE CONTAINING IN PARTICULAR PAPER MONEY

FIELD OF THE INVENTION

The invention relates to a housing, in particular a safelike housing. for accommodating at least one cassette in particular a cassette containing paper money in an automatic teller machine.

BACKGROUND OF THE INVENTION

From the IBM 4731 money dispensing unit, a housing, in particular a safelike housing, is known which contains several cassettes with paper money. This housing has an output opening in its upper wall, as well as means for outputting banknotes from the housing through said output opening. In one side wall, a doorlike opening is provided. Also provided are a carrier frame holding the cassettes and a slide rail assembly accommodating the carrier frame along with the cassettes. By means of the slide rail assembly, the carrier frame with the cassettes may be moved out of the housing through the doorlike opening for exchanging the cassettes.

In this prior art arrangement, the slide rail assembly is located at the bottom of the housing. The carrier frame for the cassettes is arranged on the slide rails. The banknotes exit at the top end of the carrier frame through the opening provided in the upper housing wall to be picked up by a transport device feeding them to a predetermined output point.

The distance between the output point of the money within the housing and the pick-up point of the connected transport device is critical. The prior art arrangement, shown in FIG. 2 in greater detail, requires much time and effort to accurately keep this critical distance, as at that particular point there are several tolerances complementing each other in a negative sense. Such tolerances are attributable to the constant dimensions of respectively the interior and the height of the housing, tolerances of the slide rails, the pulleys with which they are provided, and last but not least the tolerances in the overall height of the carrier frame itself. In practice, elaborate adjustments are required to keep this critical distance between the output and the pick-up point.

SUMMARY OF THE INVENTION

It is the object of the present invention to design the housing, carrier and slide mechanism such that the afore-mentioned disadvantages can be avoided by simple means, the critical distance between output and pick-up points is reliably kept with a minimum of effort, and the carrier frame is also substantially suitable for different cassette sizes, This object is basically accomplished by designing the carrier as a yoke. The slide rail assembly which supports the carrier yoke is mounted to the upper wall of the housing in which the output opening is provided, the carrier yoke is designed for suspending the cassettes, as specified in the independent claims. As the slide rail assemblies accommodating the carrier frame are arranged on the upper housing wall, unfavourable tolerances are prevented from accumulating. In addition, it is possible to design the carrier frame such that cassettes of different size may be suspended therein, which facilitates the keeping of components.

Further advantageous embodiments and developments of the basic solution according to the invention are specified in the dependent claims. The advantages obtained from the invention are clear and in addition, certain aspects will be described in detail below, in conjunction with the invention.

BRIEF DESCRIPTION OF THE DRAWING

For ease of appreciation, a prior art housing will be described in detail below by way of examples shown in the figures, followed by a detailed description of an example of the housing according to the invention and shown in the drawings wherein.

DESCRIPTION OF THE PRIOR ART

Figure 2:
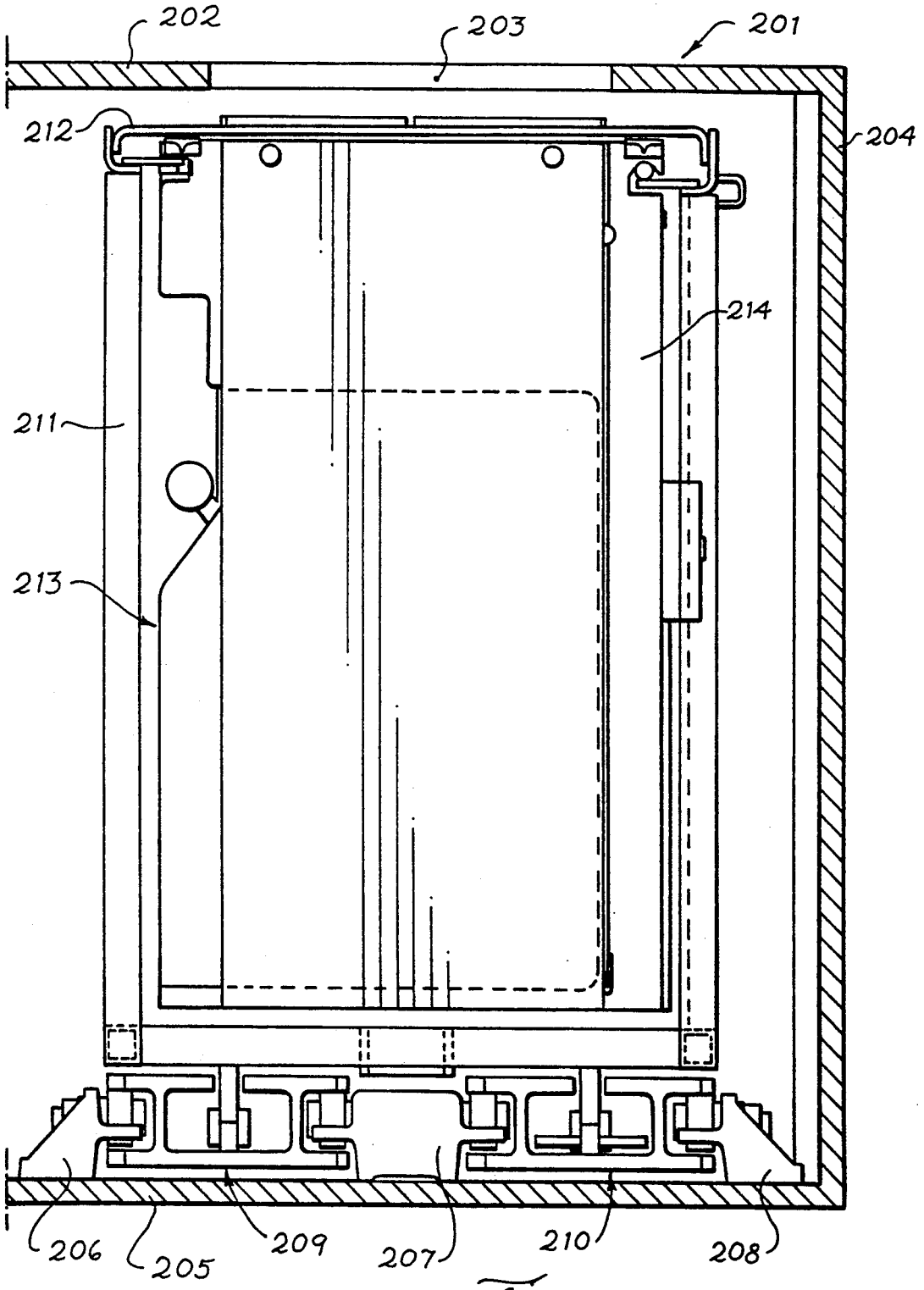
FIG. 2 is a sectional view of the slide rail assembly arranged at the bottom according to the prior art design.

For ease of appreciation, the invention and the basis from which it proceeds will initially be described by means of FIG. 2 with respect to the prior art arrangement. As previously mentioned, this arrangement is known from the IBM 4731 money dispensing unit. A safelike housing 201 has an upper wall 202 with an opening 203, a sidewall 204, and a base 205. FIG. 2 shows only a detail of the safe. In this side view two slide rail assemblies 209 and 210 are mounted on retainer blocks 206, 207 and 208 at the base 205. A carrier frame 211 is fixed to the two slide rail assemblies 209 and 210. This carrier frame surrounds the cassette 213 along with the frame 214, suspended from the connecting piece 212 at the upper end, both on the base and its sides. It is clear that tolerances resulting from the distance between the top portion or the upper wall 202 of the housing and the base 205 the heights of the retainer blocks 206, 207 and 208, the slide rail assemblies 209 and 109 may unduly accumulate, so that the distance between the upper connecting piece 212 and the opening 203 or a part positioned there is difficult to keep. For accurately keeping this critical distance, elaborate and costly adjustments are necessary.

DESCRIPTION OF A PREFERRED EMBODIMENT

Figure 1:
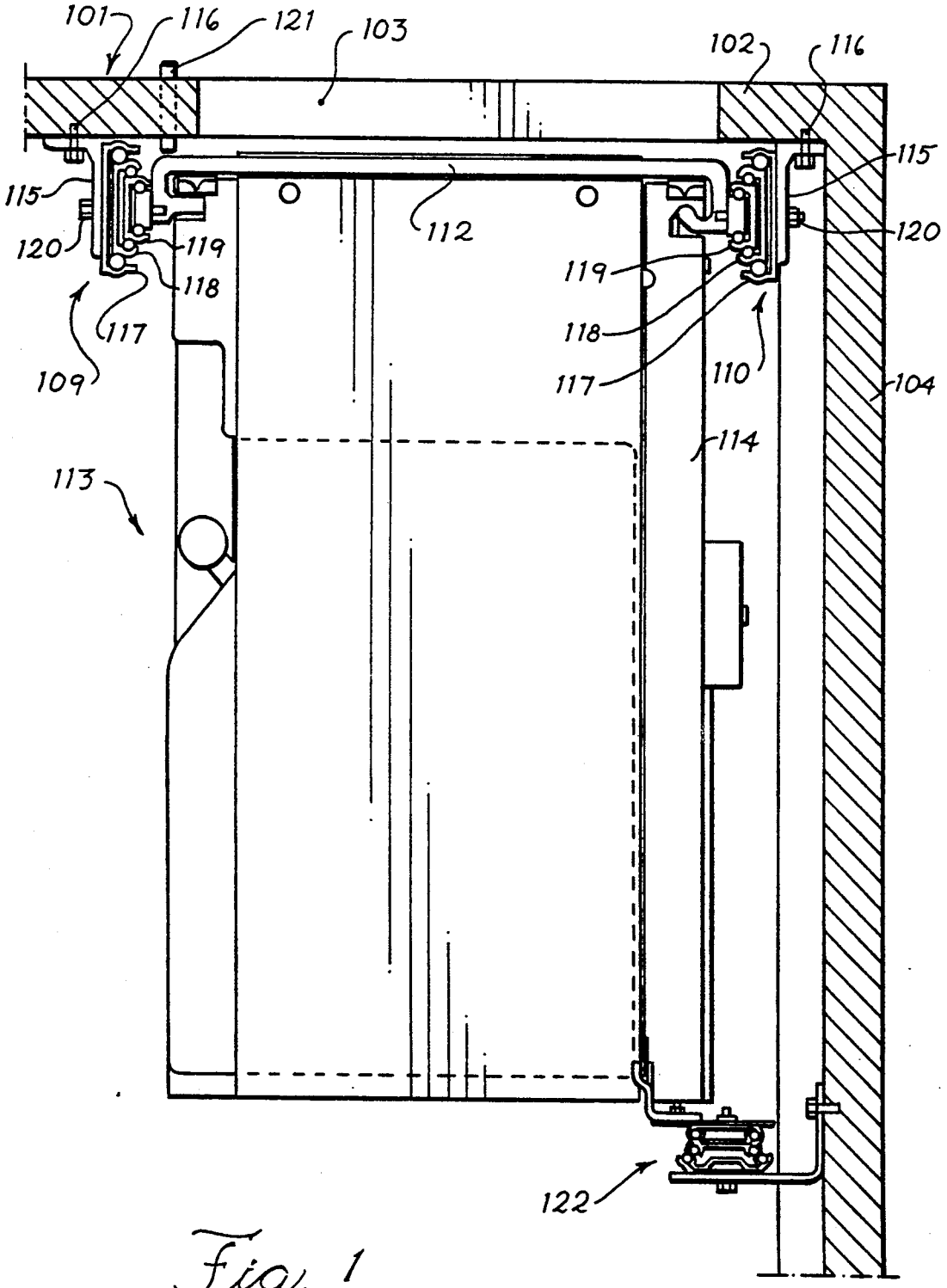
FIG. 1 is a sectional view of the housing with the slide rail assembly arranged on the upper housing wall according to the invention.

The invention will be described in detail below with reference to FIG. 1 showing a side view of a detail of the safe 101. Of the safe 101, the upper wall 102 with its opening 103 and the side wall 104 are shown. According to the invention, slide rail assemblies 109 and 110 are arranged on the upper wall 102. The slide rail assemblies each consist of an angular bracket 115 fixed to the top portion or the upper wall 102 of the housing by means of screws 116. The slide rail assemblies consisting of three rails 117. 118 and 119 fitted into and displaceable relative to each other are fixed to the angular brackets 115 by means of screws 120. Thus, the two slide rail assemblies 109 and 110 are fixed to the upper wall 102 of the safe 101 where the banknotes or other sheetlike media exit through the opening 103 to be picked up by a transport device, not shown. Between the two slide rail assemblies 109 and 110, a carrier yoke 112 acting as a carrier frame is provided which is laterally connected to the inner-most rail 119 of the slide rail assembly 109 and 110, respectively. A comparison of this part and the carrier frame 211 of FIG. 2, which consists of two lateral parts, the base part and the upper part 212, shows that the design of the carrier frame according to the present invention is much simpler. Lateral supports are not required, as the carrying yoke 112 is sufficient. This yoke serves to suspend the cassettes 113 on the one hand and the associated frame 114 on the other. As is also shown in FIG. 1, an index pin 121 is inserted in the upper wall 102 of the safelike housing 101 to the left of the opening 103. This index pin 121 determines the distance between the upper end of the carrier frame 112 and a transport device, not shown, arranged above the safe 101 (FIG. 1) and protruding partly into the opening 103. As a result, the critical distance between the output unit inside the safe and the transport device arranged above the latter is clearly determined. This shows that only the tolerances in the area of the slide rail assemblies are of any significance in this case and that, compared to the prior art arrangement of FIG. 2 there are far fewer tolerances affecting the critical distance.

In FIG. 1 a further slide rail assembly 122 is arranged in the bottom portion of the frame 114 on the side wall 104. This slide rail assembly 122 has no supporting function but serves to laterally stabilize the guide action, in particular when the carrier frame 112 with its cassettes 113 is moved out of the housing 101 on the slide rails.

Figure 3:
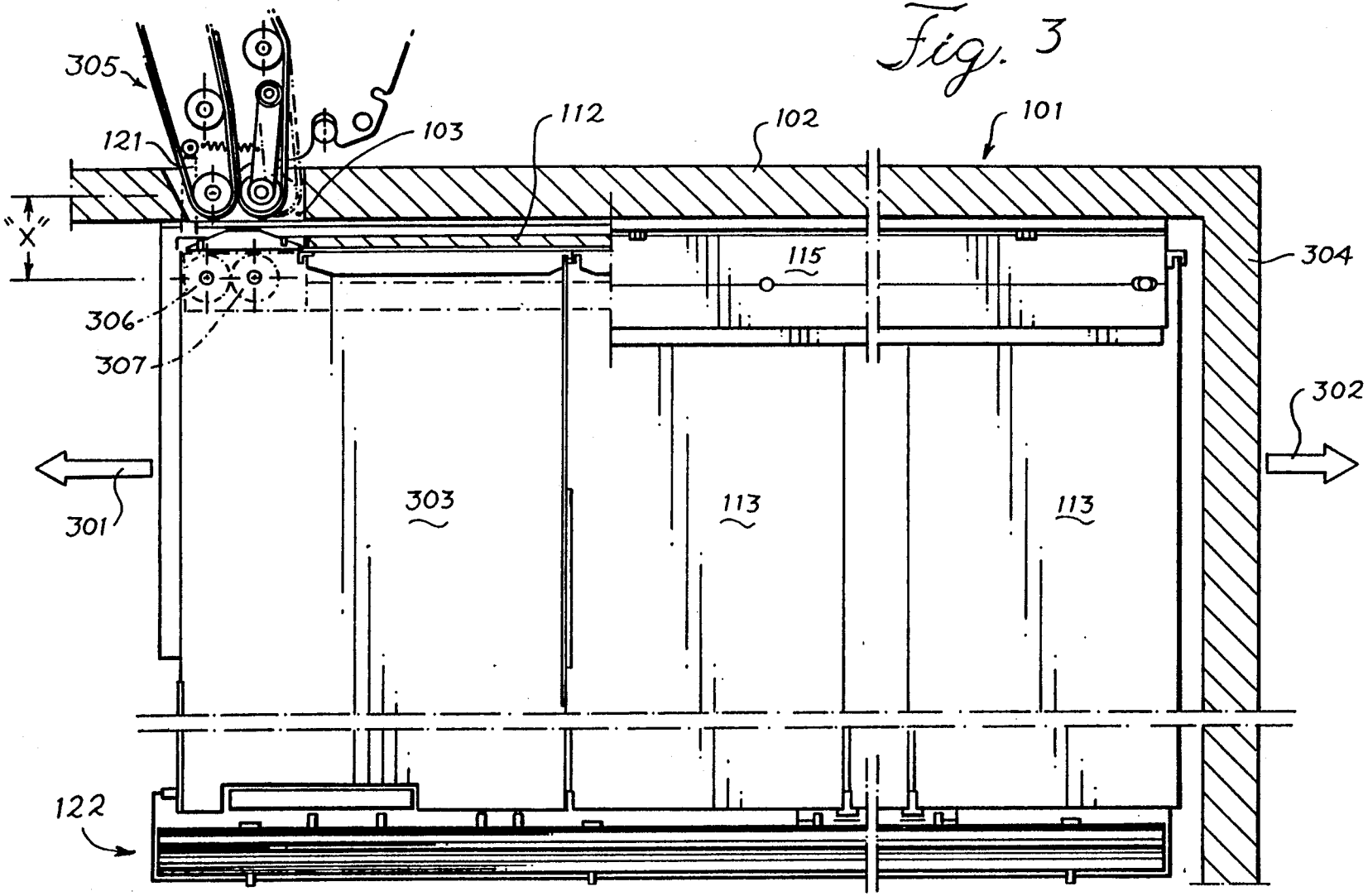
FIG. 3 is a side and full view of the motional range of the carrier frame, as well a detail of the pick-up point with the critical distance.

The arrangement and facility of this preferred embodiment are shown in FIG. 3 and marked by two opposite arrows 301 and 302. The side view of FIG. 3 shows, rotated by 90° relative to FIG. 1, details of the interior of the safelike housing 101. Below the slide rail assemblies 109, 110, covered by the fixing arm 115, two cassettes 113 and a stacker and output unit 303 are shown. Below these, the slide rail assembly 122 is visible which serves to laterally stabilize the guide action, in particular when the carrier frame 112 is moved out of the safe 101 through the side doors 309 provided thereon in the direction of arrow 301 or arrow 302. Viewing from the side, a transport device 305 protrudes into the opening 103 in the top portion or upper wall 102 of the safe 101. As illustrated, this transport device may substantially consist of two belts, resting against each other, on which banknotes or sheetlike media are moved via pulleys from the stacker or output unit 303 towards the top in the direction of the wedge between the belts of the transport device 305. The distance between the centers of the deflection and the transport pulleys 306 and 307 and the pulleys of the transport device 305 may be referred to as the critical distance X which is shown in FIG. 3 for information. Also shown in this figure is the index pin 121 which determines this distance X between the stacker and output unit 303 and the transport device 305.

The design of the housing for accommodating money cassettes and preferably also the stacker and output unit 303 has been favourably and noticeably improved according to the invention. Tolerance problems are greatly reduced and a simple carrier yoke 112 serves to accommodate cassettes for, say, 2000 banknotes along with the associated frame or larger cassettes for as many as 3000 banknotes along with the associated frame. This does not make any difference to the suspension or the design of the carrier frame 112 and constitutes a substantial advantage over the prior art, as the critical distance X is reliably kept.

While these and other advantages of the invention have been illustrated in connection with a preferred embodiment, it will be understood by those of skill in the art of automatic teller machine design that many variations in implementation may be made without departing from the spirit and scope of the invention which are defined by the following claims.

What is claimed is:

1. A safelike housing, for accommodating at least one cassette comprising:

an output opening in its upper wall;

means for outputting sheetlike media from the housing through said output opening;

a doorlike opening in one side wall;

a carrier means retaining the cassettes;

a slide rail assembly accommodating the carrier means and which is designed such that the carrier means may be moved out of the housing through the doorlike opening, the carrier means being designed as a carrier yoke, the slide rail assembly, accommodating the carrier yoke being positioned on the upper wall of the housing in which the output opening is provided, the carrier yoke being designed for suspending the cassettes therein, and the carrier yoke upper part is preferably laterally connected to the slide rail assembly.

2. The housing of claim 1, further comprising:

another slide rail assembly for laterally stabilizing the guide action is provided on a side wall of the housing.

3. The housing of claim 2 wherein:

said housing along with the carrier yoke is designed such that cassettes of different size and capacity may be inserted into the carrier yoke.

4. The housing of claim 3 wherein:

said doorlike opening is provided in one wall of the housing, and said slide rail assembly and carrier yoke may be moved at least partially out of said housing.

5. The housing of claim 4 wherein:

said stacker and output means for the sheet-like media is suspended in the carrier yoke and moved along with the slide rail assembly.

6. A safelike housing, for accommodating at least one cassette comprising:

an output opening in an upper wall of the housing;

means for outputting sheetlike media from the housing through said output opening;

a doorlike opening in one side wall;

a carrier means retaining the cassettes;

a slide rail assembly accommodating the carrier means and which is designed such that the carrier means may be moved out of the housing through the doorlike opening, the slide rail assembly accommodating the carrier being positioned on the upper wall of the housing in which the output opening is provided;

a transport device being mounted on a top surface of the upper wall of the housing and protruding into the output opening;

an index pin mounted in the upper wall, one end of the index pin being in contact with the transport device and the other end of the index pin being in contact with the carrier;

whereby a distance is maintained between the transport device and the carrier.

* * * * *